United States Patent [19]

Bold, Jr.

[11] Patent Number: 4,775,147

[45] Date of Patent: Oct. 4, 1988

[54] INERTIAL FORCE EXERCISE DEVICE HAVING THREE INDEPENDENT ROTATIONAL INERTIA SYSTEMS

[76] Inventor: Thomas P. Bold, Jr., 6121 Winter Park Dr., Burke, Va. 22015

[21] Appl. No.: 753,821

[22] Filed: Jul. 11, 1985

Related U.S. Application Data

[63] Continuation-in-part of Ser. No. 632,824, Jul. 20, 1984.

[51] Int. Cl.[4] ..... A63B 21/22

[52] U.S. Cl. ..... 272/127; 272/122; 272/128

[58] Field of Search ..... 272/122, 123, 127, 128; 384/276

[56] References Cited

U.S. PATENT DOCUMENTS

| | | | |
|---|---|---|---|
| 578,637 | 3/1897 | Hebbard | 384/276 |
| 2,642,286 | 6/1953 | Leroy | 272/127 |
| 2,676,802 | 4/1954 | O'Brien | 272/122 |
| 3,482,835 | 12/1969 | Bean | 272/122 |
| 4,171,805 | 10/1979 | Abbott | 272/127 |

FOREIGN PATENT DOCUMENTS

| | | | |
|---|---|---|---|
| 598554 | 10/1959 | Italy | 272/122 |
| 238831 | 8/1925 | United Kingdom | 272/123 |

*Primary Examiner*—Richard J. Apley
*Assistant Examiner*—J. Welsh

[57] ABSTRACT

This invention relates to an inertial force, accommodating resistance exercise device for developing and maintaining cardiovascular condition, flexibility, coordination, strength, and endurance. The subject device gives these benefits to the user by providing the capability to acceleratedly translate inertial mass across a surface in order for the user to experience accommodating, inertial force resistance. The device includes inertial mass connected to an axle and at least one wheel connected to the same axle whereby the device may be rapidly rolled to present the opposition of translational inertial force during a variety of exercise routines. Certain disclosed embodiments of the subject device eliminate and minimize the generation of undesirable torque by the inertial mass, and enhance and maximize the generation of pleasing single vector resistance offered by the inertial mass in accelerated translation during exercise. These embodiments accomplish this effect by establishing the inertial mass and control section for the device in separate systems of rotational inertia whereas in other disclosed embodiments they are united in the same system.

10 Claims, 1 Drawing Sheet

FIG. 1
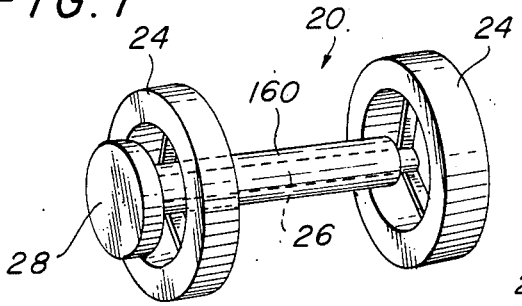
FIG. 2
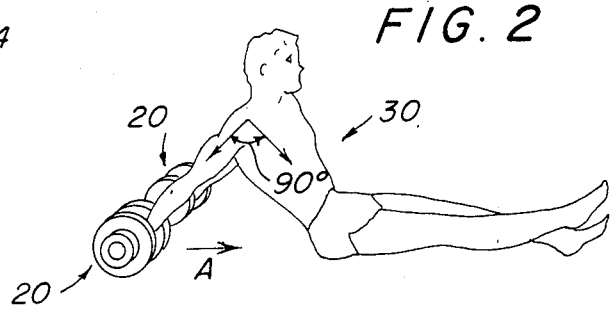
FIG. 3
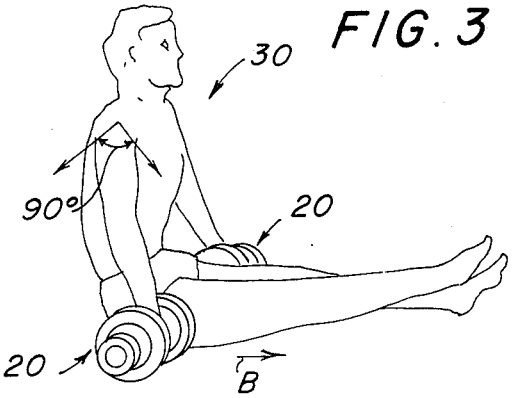
FIG. 4
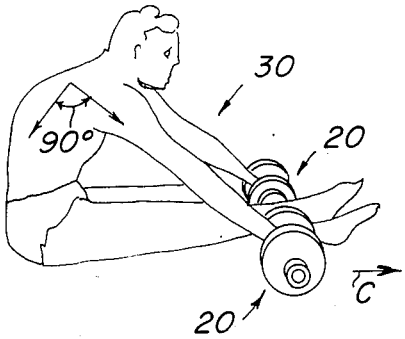
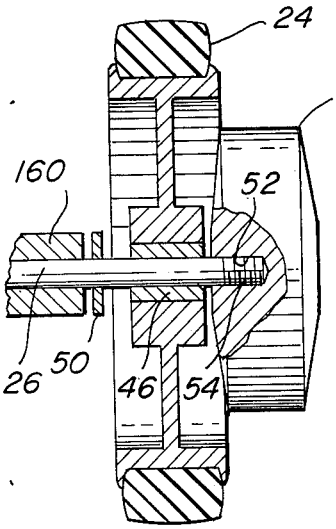
FIG. 5
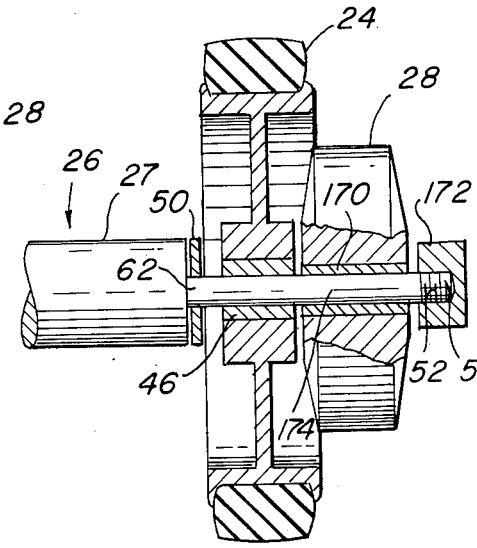
FIG. 6
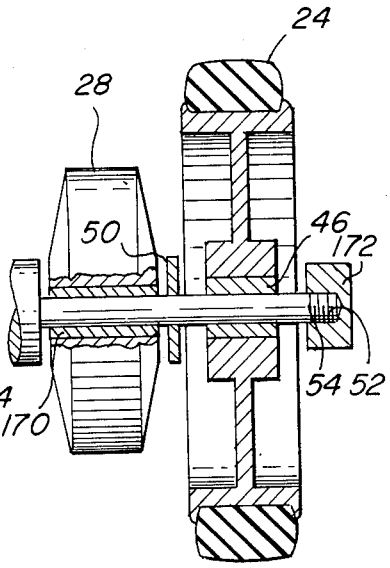
FIG. 7

INERTIAL FORCE EXERCISE DEVICE HAVING THREE INDEPENDENT ROTATIONAL INERTIA SYSTEMS

This is a continuation-in-part application of U.S. patent application Ser. No. 632,824, still pending.

BACKGROUND OF THE INVENTION

This invention relates to an inertial force, accommodating resistance excercise device and method. More specifically, this invention relates to a device and method for generating an opposing force to exercise a user with accommodating resistance primarily through a controlled effort employed by a user of the instant device to overcome inertia of a mass in translation when the device is repeatedly accelerated and decelerated during surface oscillations.

Exercise devices have in common the necessity of enabling a user to experience an opposing force in order to provide resistance to the muscles of the body for the purpose of exercising. This necessity is predicated upon Newton's third law of motion which states that for every force that is exerted by one body on another, there is an equal and opposite force exerted by the second body on the first. The muscles of the body and an exercise device demonstrate the application of this law in an action/reaction combination during the performance of exercise.

With respect to the reaction half of the combination, exercise devices have in the past been designed to take advantage of a variety of forces. Gravity force devices are designed to cause a user to move weight against an opposition provided by the force of gravity, as in the case of barbells or a universal gym. Resilience force devices are designed to cause a user to deform an object such as a spring or elastic band whose resilience properties oppose action by the exerciser. Pneumatic force devices are designed to cause a user to compress or exhaust air in a chamber in order to create opposition, as in the case of most rowing machines. Rotational inertia force devices are designed such that a user experiences resistance when rotation of a metal disk or a flywheel is initiated, as in the case of Nordic ski machines. Friction force devices are designed to cause a user to overcome friction of two interacting surfaces such as between a strap and a flywheel of an exercise cycle. Mechanically-determined force devices are designed to cause a user to overcome the resistance of levers or cables as determined by a speed governor, as in the case of a Cybex machine or a Mini-Gym.

By taking advantage of such forces, exercise devices in the past have enabled a user to perform three basic types of exercise: isotonic, isometric, and accommodating resistance.

Gravity force and resilience force devices are generally used to perform isotonic exercise wherein a muscle shortens and lengthens with varying tension while overcoming and releasing a constant load. In isotonic exercise, the weight or resistance used to exercise is limited to the force that can be overcome at the position or angle where the muscles are weakest in a range of motion. The tension on the muscle is maximal only at that position or angle. In this type of exercise, the speed of motion is relatively slow compared to the rapid movements needed for many sports activities.

Gravity force and resilience force devices are also suited to perform isometric exercise wherein a muscle is given static tension by holding the device in a fixed position. This type of exercise is also commonly performed by pressing against any immovable object. In isometric exercise, there is no motion, and significant gains in strength are specific only to the particular angle or position chosen for the contraction of the muscle.

Exercise devices which take advantage of pneumatic force, friction force, mechanically - determined force, etc., are generally used to perform accommodating resistance exercise (also referred to as isokinetic exercise). In accommodating resistance exercise tension on a muscle varies in direct proportion to the effort expended by the user and is controlled rather than being predetermined by a fixed resistance. Accommodating resistance exercise allows for maximum contraction or tension of a muscle at all joint angles over a full range of joint motion used to perform the exercise and also allows for the speed of movement required for various sports activities to be duplicated by teaching a more efficient activation of muscles by the nervous system. Accommodating resistance exercise, as the basis for a training program, has been rated by many as being superior to isotonic and isometric exercise with respect to rate of strength gain, rate of endurance gain, strength gain over a range of motion, adaptability to specific movement patterns, least possibility of injury, and skill improvement.

In using exercise devices which have been designed to provide accommodating resistance, minimum resistance is experienced when a speed of operation is slow and a greater resistance is experienced when a speed of operation is increased. These devices allow the body to work hard in positions where the body is structured to do hard work and to ease off in positions where the skeletal-muscular system is weak. Rowing machines which employ a pneumatic force to provide opposition, exercise cycles which employ rotational inertia and friction forces to provide opposition, and a Cybex machine which employs a mechanically-determined force to provide opposition are examples of exercise devices which have been designed to take advantage of various opposing forces to enable a user to perform accommodating resistance exercise.

Although machines known in the past have achieved a degree of user acceptance in accommodating resistance training, it would be desirable to create an exercise device capable of taking advantage of an inertial force which is the result of rectilinear or curvilinear translation of an object in order to perform accommodating resistance exercise routines. This type of inertial force is the resistance of an object due to its inertia when the object is accelerated linearly without rotation. (Hereafter, reference to an inertial force will mean an inertial force which is the result of translation of a mass. An inertial force which is the result of rotation of a mass will be so designated.)

An exercise device designed to take advantage of an inertial force is predicated upon what is perhaps the most fundamental property possessed by all objects—inertia. The inertia of an object is a measure of the difficulty in changing the state of rest or motion of the object.

The principles which provide the theroetical basis for an exercise device which enables a user to create and overcome an inertial force to perform accommodating resistance exercise are expressed in Newton's first and second laws of motion. The first law is sometimes referred to as the law of inertia and states that a body continues in a state of rest or motion in a straight line unless it is compelled to change that state by an external force exerted upon it. In other words, because objects possess inertia, an object at rest tends to remain at rest, and an object in motion tends to remain in motion. If the state of rest or motion of an object is altered (start, stop, change direction), a force is needed to accelerate/decelerate the object.

The relationship between an object, force, and acceleration may be expressed in Newton's second law of motion which states that a body acted upon by an external force undergoes an instantaneous acceleration proportional to and in the direction of the force applied to the body. According to this law, the magnitude of force for a given acceleration depends upon the inertia of the object as measured by the object's mass. Simply expressed, the force "F" required to give a mass "m" an acceleration "a" is proportional to both "m" and "a", or $F=ma$.

As previously noted, Newton's third law states that the action of a force to cause acceleration results in a reaction of an equal and opposite force. This reaction force is an inertial force. The equation, $F=ma$, indicates that the magnitude of the inertial force can be modified by varying the size of the mass, while the rate of acceleration remains constant. It indicates the inertial force can be modified by varying the rate of acceleration while the size of the mass remains constant. Controlling the rate of acceleration causes the resistance offered by the inertial force to be accommodating.

An exercise device created to utilize inertial force to provide accommodating resistance would be particularly appropriate for physical conditioning and sports training because inertial forces are commonly experienced in moving one's body and in giving motion to external objects. Inertial forces in physical activities are easy to distinguish by the requirement that they come into existence when initiating, maintaining, and terminating motion. Inertial forces provide the predominant resistance when one give motion to external objects in activities such as throwing or kicking a ball, swinging a racket or bat, blocking or tackling a player in football, etc. They provide the predominant resistance when one gives rapid motion to one's body or its parts in activities such as jumping, leaping, running, swimming, skating, etc.

One of the benefits of inertial force training has to do with the development of cardiovascular or aerobic fitness. Aerobic fitness is the ability of the heart, blood, and blood vessels to transport oxygen to muscle cells, process the oxygen in those cells, and carry off the resulting waste products. Aerobic fitness is considered by many to be the most important component of overall fitness. Physical activities which produce strong, opposing inertial forces through the rapid motion of one's body advantageously improve and sustain aerobic fitness.

Inertial forces are involved in most popular physical activities used for cardiovascular development. In running, they are involved in accelerating from a stationary position, in the swinging of the arms and legs, and in the dynamics of landing and takeoff as the body is propelled across a surface by the legs. In swimming, inertial forces are generated in overcoming the inertia of the body in the water, in swinging and kicking the legs, and in overcoming the inertia of the water in repeated stroking and kicking. In rowing, inertia is involved in overcoming the stationary position of a boat, in the resistance offered by the mass of oars, and in overcoming the inertia of water with the oars as the boat is rowed.

In a physiological manner similar to the above popular physical activities, an inertial force exercise device would advantageously contribute to aerobic fitness by featuring an opposition of inertial force in exercises which are continuous and rhythmic and which involve a user's major muscle groups. The use of such a device is further analogous to engaging in aerobic activities such as described above in that the strength of the inertial force can be controlled by varying the rate at which actions are performed, thereby making possible a relatively long-duration participation essential for aerobic conditioning. The aerobic benefit from a device which provides for accommodating resistance is in contrast to an exercise device which solely uses a noninertial force, such as gravity, to create an opposing force required for exercise wherein the weight being lifted is constant.

In addition to aerobic benefit, another benefit has to do with the development of flexibility. Flexibility is the range of motion possible at the joints. Joint flexibility is an important element of general health and physical fitness. Adequate flexibility is desirable for all individuals and is considered to be a possible preventor of low back pain and some of the aches and pains that accompany aging. In addition, improved performance in many sports activities and the prevention of injury and soreness can result from an appropriate program of flexibility development. Flexibility is joint and activity specific. Physical activities which require the greatest range and frequency of movement about a joint and which require significant effort to overcome inertial forces in accomplishing the movement are those which contribute most to flexibility. In this regard, swimming, handball, squash, Nordic and Alpine skiing, and tennis are rated very highly. Therefore, the creation of an inertial force exercise device would provide the user opportunities to contribute to the flexibility of the joints of arms and legs through the opposition of inertia to muscles, ligaments, and tendons. Swinging and reaching motions would closely approximate the rapid motions in the physical activities rated highly for their contribution to flexibility.

Still another benefit of inertial force training has to do with the development of coordination. Coordination is the ability of the muscles to cooperate in order to perform a variety of sports and other physical activities involving rapid movement. The experiencing of inertial force resistance is essential to the development of coordination because of the link between acceleration and coordination. Coordination in sports activities is required when accelerating the body and its parts or when accelerating an object using the body. Improved coordination is realized by repeated accelerated movements to overcome inertia. In fact, training programs are designed to duplicate the movement requirements of a sports activity with respect to the muscles employed, with respect to the range of joint action, with respect to the speed of acceleration, and with respect to the inertial resistance experienced while performing the activity. Most often achieving this duplication involves practicing the specific activity. However, the creation of an inertial force exercise device would permit the approximate duplication of the movement patterns associated with a sports activity without having to engage in the specific activity thereby providing a significant training alternative. For example, the creation of such a device would be particularly attractive to supplement the training required for swimming by duplicating the inertial force resistance experienced from the water thereby relieving the demands for pool time required by competitive athletes.

Yet, still another benefit of inertial force training has to do with the development of muscular strength and endurance. Muscular strength is the amount of force that can be exerted by a single contraction of particular muscles. Muscular endurance is the length of time an activity can be sustained by particular muscles. Developing and maintaining muscular strength and endurance is best achieved by physical activities which permit the maximum contraction of effort of a muscle through the full range of joint motion and which permit the contraction to be repeated. Physical activities, particularly those which involve rapid and repeated motion by the limbs of the body or which involve the limbs to give rapid and repeated motion to external objects, permit the full exertion of the body's muscular capacity in overcoming the inertia of the limb or the limb in combination with an external object. Therefore, physical activities that overcome strong inertial forces provide a means of increasing and sustaining muscular strength and endurance in a way considered to be most desirable.

Examples of activities which permit a maximum and repeated contraction of a muscle or muscle group through a range of motion required to perform the activity include swimming, wherein the limbs may experience maximum resistance from the water; rowing, wherein maximum resistance may be experienced from the water through the oars; skating, wherein the legs may experience maximum resistance in pushing off against a surface; boxing, wherein the arms may experience maximum resistance in swinging and striking; etc.

Physical activities such as described above permit a maximum contraction of muscles through a specified range of motion because the resistance provided by inertial forces is accommodating. The magnitude of the inertial force or opposing force is dependent on the acting force of the body. That is to say, the resistance experienced by the muscles at any point during an acceleration will be dependent upon the force the muscles are able to exert at that point. The resistance is accommodating in proportion to the changing muscular capability at every point in the range of motion. Accommodating resistance during these activities allows all muscles and muscle groups, irrespective of their relative strength, to undergo maximum contraction during an entire range of motion and for these contractions to be repeated, thereby providing for muscular strength and endurance. Accordingly, it would be highly desirable to create an exercise device which would enable a user to experience the same opportunities to develop and maintain muscular strength and endurance through accommodating resistance offered by an inertial force as physical activities such as those described above.

The invention which is the subject of the instant patent is a device of a mass translation type which has been created primarily to take advantage of translational inertial force as the opposing force necessary for accommodating resistance exercise to provide the benefits described above having to do with developing and maintaining aerobic fitness, flexibility, coordination, muscular strength, and muscular endurance.

The subject invention falls in the category of surface - operated exercise devices which are generally rolled on a surface to perform exercises.

In the past, inventions in this category have most often been designed to take advantage of gravity as the means of establishing the opposing force necessary for exercise. One design comprises a single wheel on a shaft. Another design comprises two double-wheeled, foot-mounted devices. Other designs comprise rollable devices—one for each hand—with unique features such as the use of tracks, the use of brakes, the use of resistance springs, the use of casters, etc. Gravity becomes the opposing force as these devices are used in performing exercise to support, raise, or lower the body of the user in relation to the surface.

In addition to taking advantage of gravity as the opposing force, other inventions in this category have been designed to take advantage of the resistance offered by the inertia of a rotating mass. One design comprises two disk-shaped weights as the wheels of the device. Another design comprises spherically-shaped, rotatable weights as the means for rolling the device.

These previous inventions in the category of surface-operated exercise devices require a significant downward force vector to be applied and maintained as a user exerts effort to support the weight of the body and/or to overcome the rotational inertia of the weighted rotating members. This requirement limits the range of exercise that may be performed and the benefits that may be derived therefrom. It limits the freedom and rapidity with which these devices may be moved on a surface. It limits the community of users to those already in the possession of sufficient upper body strength to exert the pressing force required to support the body weight in various attitudes and positions and to rotate mass and to change the direction of rotation.

The difficulties suggested in the preceding are not intended to be exhaustive, but rather indicate a lack of appreciation in the prior art for significance of surface-operated, inertial force exercise devices and methods. Other noteworthy problems may also exist; however, those presented above should be sufficient to demonstrate that surface-operated exercise devices and methods, which use only gravity and/or the inertia of rotating mass as a means of establishing opposition, will admit to worthwhile improvement.

A significant improvement in the art may be appreciated by reference to applicant's above identified application Ser. No. 632,824. Notwithstanding the advances provided by applicant's previously disclosed inertial force accommodating resistance exercise device, in certain instances, room for worthwhile improvement remains. More specifically, the prior application shows a device with two rotational inertia systems which operate together in the linear translation of mass on a surface during the performance of the exercise. The wheels, in contact with a surface, are members of one of the systems; the axle and the inertial mass unified with the axle are members of the other. This configuration is suitable when the user does not rotate the control area of the axle as in exercise routines which involve pushing, pulling, punching or thrusting maneuvers. However, in certain exercise routines, the device is rapidly translated by the extended arm back and forth across a surface in an arc of approximately 90 degrees with respect to the user's shoulder. In these routines, the inertial mass attached to the axle gripped by the user at the control area rotates through this same angle of approximately 90 degrees. This type of surface translation is characterized by a rapid acceleration and deceleration of the device in one direction and then a rapid acceleration and deceleration of the device in the opposite direction repeated again and again. When the axle and inertial mass are joined as members of a rotational inertia system, the 90 degree rotation of the inertial mass and the reverse of this rotation during these repeated translations generates an undersirable rotational force on the hand and wrist of the user particularly at the change from rapid deceleration in one direction to rapid acceleration in the opposite direction. At the change, the axle is influenced to twist in the hand of the user creating resistance antagonistic to the pleasing experience of accommodating, single vector resistance offered by inertial mass in linear translation. Accordingly, it would be highly desirable to provide an enhanced device which would incorporate at least one member of a third rotational inertia system as a means of placing the control area of the device in a system separate from the inertial mass in order to achieve the advantageous effects of the applicant's previously disclosed invention while concomitantly eliminating or minimizing the generation of torque by the inertial mass during certain exercise routines.

OBJECTS OF THE INVENTION

It is therefore a general object of the invention to provide a novel inertial force, accommodating resistance exercise device which will obviate or minimize disadvantages and/or limitations of previously known devices of the type previously described.

It is another generally object of the invention to provide a novel inertial force, accommodating resistance exercise device which will give an improved means of exercising to develop aerobic fitness, muscular strength, muscular endurance, and flexibility, primarily by taking advantage of an inertial force as the opposing force in performing accommodating resistance exercise.

It is a further general object of the invention to provide a novel inertial force, accommodating resistance exercise device which will minimize difficulties of prior surface-operated devices through improvements in exercise techniques offered by mass in translation and the overcoming of inertial forces on a variety of surfaces.

It is a specific object of the invention to provide a novel inertial force, accommodating resistance exercise device wherein an internal mass may be translated on a surface such as a floor or wall in order to generate an inertial force to exercise the body as the device is repeatedly accelerated and decelerated in a oscillating pattern.

It is another object of the invention to provide a novel inertial force, accommodating resistance exercise device wherein an inertial mass may be translated easily with minimized torque forces for the purpose of causing a continuous, rhythmic, and fluid series of actions and reactions in generating a pleasing single vector resistance offered by inertial mass in accelerated, linear translation.

It is a further object of the invention to provide a novel inertial force, accommodating resistance exercise device wherein an inertial mass may be varied through an uncomplicated mechanism.

It is yet another object of the invention to provide a novel inertial force, accommodating resistance exercise device wherein the device allows an arm or leg a full range of motion during exercise with no interference.

It is still a further object of the invention to provide a novel inertial force accommodating resistance exercising device which permits a user to perform a series of exercises in a sitting, standing, kneeling, or lying position on a floor or in a standing or lying position on a wall to strengthen all major muscle groups and develop flexibility, endurance, and aerobic capacity.

It is still another object of the invention to provide a novel inertial force, accommodating resistance exercise device which is suitable as a training alternative for physical activities of the athletic variety because exercises using the device duplicate the requirements of those activities with respect to the coordination required, with respect to the muscles employed, with respect to the range of joint action, and with respect to the speed and resistance demands of the movement patterns.

It is yet still another object of the invention to provide a novel inertial force, accommodating resistance exercise device which can be used for the general fitness of all age groups and the rehabilitation of injured or weakened limbs, joints, muscles, etc., because the user can vary the inertial force by varying the rate of acceleration of the device to perform accommodating resistance exercise in accordance with the condition and requirements of the user.

It is a further object of the invention to provide a novel inertial force, accommodating resistance exercise device which allows a wide range of exercises which are easy to learn and to perform safely in a variety of settings such as a home, office, or gym environment.

It is another object of the invention to provide a novel inertial force, accommodating resistance exercise device which is relatively affordable, portable, and versatile thereby providing a means for accomplishing overall fitness which is a significant alternative to more expensive and complex exercise devices available to consumers through fitness centers or through home installation.

It is still another object of the invention to provide a novel inertial force, accommodating resistance exercise device which is aesthetically pleasing and entertaining to use because of the continuous, fluid, and rhythmic oscillation of the limbs of the body during exercises analogous to limb movements in running, swimming, skating, etc.

It is yet another object of the invention to provide a novel inertial force, accommodating resistance exercise device which offers significant advantages with respect to the simplicity of mechanical operation of the device, the economy of parts in the construction of the device, and the economy of cost in the mass production of the device.

It is also an object of the invention to provide a novel inertial force, accommodating resistance exercise device in accordance with one or more of the above objectives which also eliminates or minimizes the generation of torque by the inertial mass and which enhances or maximizes the user's expereince of pleasing single vector resistance offered by inertial mass in accelerated, linear translation.

BRIEF SUMMARY OF A PREFERRED EMBODIMENT OF THE INVENTION

A preferred embodiment of the invention which is intended to accomplish at least some of the foregoing objects comprises an inertial force, accommodating resistance exercise device having three rotational inertial systems. Two co-rotating wheels are members of a first rotational inertial system, said wheels being rotatably mounted on said axle. Said axle and inertial mass coupled thereto are members of a second rotational inertial system. A sleeve, through which said axle extends, is a member of a third rotational inertia system. The three systems are mutually independent whereby said sleeve is free to rotate on said axle during the repeated deceleration/acceleration direction changes of the translated device in order to eliminate or minimize the generation of torque by the inertial mass. The operation of the sleeve in this manner maximizes the user's experience of attractive, one dimensional resistance offered by the inertia of mass in translation during all exercise routines by minimizing or reducing generation of torque. The inertial mass continues to be fixably attached to said axle and remains nonrotatingly driven by rotation of said wheels as the device is rapidly rolled on a surface in order to generate the resisting inertial force.

BRIEF SUMMARY OF SECOND PREFERRED EMBODIMENT OF THE INVENTION

A second preferred embodiment of the invention which is also intended to accomplished at least some of the foregoing objects comprises an inertial force, accommodating resistance exercise device also having three independent rotational inertia systems. Two co-rotating wheels are part of a first rotational inertia system, operable to engage and roll upon said surface during an exercise routine. An axle is part of a second rotational inertia system and extends through said wheels. Said wheels are pivotably and rotatably mounted on the axle for rotation with respect to the axle to permit the axle to be translated across a surface without causing affirmative rotation thereof. At least one inertial mass structure is a member of a third rotational inertia system. It is rotatably connected to the axle from translation with the axle while not being fixably coupled to said wheel for co-rotation therewith. This connection permits said axle to rotate with respect to said inertial mass during rapid translation direction changes to eliminate or minimize generation of torque forces by the inertial mass. The inertial mass is thereby permitted to optimally provide linear inertial resistance through accelerated translation across a surface to exercise a user's body and and provide overall fitness through accommodating resistance exercise routines.

THE DRAWINGS

Other objects and advantages of the present invention will become apparent from the following detailed description of preferred embodiments thereof taken in conjunction with the accompanying drawings, wherein:

FIG. 1 shows an embodiment of the instant invention having first and second wheels as members of a first rotational inertia system; an axle and an inertial mass affixed to the end of said axle as members of a second rotational inertia system; and a sleeve as a member of a third rotational inertia system enveloping a portion of said axle between said first and second wheel means. The sleeve is free to turn on said axle during the accelerated surface translation of the device by the user to perform inertial force, accommodating resistance exercise. This sleeve eliminates or minimizes the generation of torque by the inertial mass when the user accelerates and decelerates the device and changes its direction of motion when rolling the device on a surface.

FIGS. 2–4 schematically disclose an accommodating resistance exercise sequence which may advantageously utilize an inertial force, accommodating resistance exercise device in accordance with the embodiment of the instant invention shown by FIG. 1 to include three rotational inertia systems in order to eliminate or minimize the generation of torque by the inertial mass.

FIG. 5 is a side elevation view of the embodiment shown in FIG. 1, partially in cross section, disclosing in greater detail the relationship between a wheel of the first system, the axle and an inertial mass of the second system, and the sleeve of the third system.

FIG. 6 illustrates another embodiment of the instant invention which will eliminate or minimize the generation of torque as required by certain exercise routines such as the one depicted in FIGS. 2–4. It shows a wheel as one member of a first rotational inertia system; an axle as a member of a second rotational inertia system; and an inertial mass as one member of a third rotational inertia system. The inertial mass contains a cylindrical bearing whereby the axle is permitted to rotate within the inertial mass. This configuration eliminates or minimizes the generation of torque by the inertial mass during surface translation when the user accelerates the device and changes its direction using the control portion of the axle.

FIG. 7 shows a variation of the embodiment of FIG. 6. The inertial mass, as one member of the third rotational inertia system, has been moved between the wheel and the control portion of the axle.

DETAILED DESCRIPTION

Referring now to the drawings and particularly to FIG. 1 thereof, there will be seen an inertial force, accommodating resistance exercise device 20 in accordance with one preferred embodiment of the invention. In this embodiment, the exercise device includes a first wheel member 22 and a second wheel member 24, as members of a first rotational inertia system. They are rotatably mounted in parallel on end portions of axle 26. The central longitudinal axle 26 is a first member of a second rotational system. An inertial mass 28, as a second member of the second rotational inertia system, is mounted rigidly upon the axle 26 at each end thereof and, outside of the wheels 22 and 24. A sleeve 160, as a member of a third rotational inertia system, envelops the axle 26 and is free to rotate on said axle upon change from rapid deceleration in one direction to rapid acceleration in the opposite direction in order to eliminate or minimize the generation of torque by the inertial mass. Sleeve 160 may be of a bearing, lubricant, or any other suitable construction for enabling rotation about axle 26.

Before continuing with the detailed description of the subject inertial force, accomodating resistance exercise force, accommodating resistance exercise device, it is worthwhile to appreciate the context of the instant invention and to disclose an exercise routine employing the subject inventive device in accordance with the embodiment shown in FIG. 1. In this connection, FIGS. 2–4 schematically disclose a sequence of accommodating resistance exercise.

More specifically, FIG. 2 shows a user 30 seated upon a floor surface. The user has thrust backward, decelerating the accommodating resistance exercise devices as he does so and translating the axles and inertial mass 28 in the process. From a rearward limit, the user 30 pulls the subject exercise device 20 forward and provides acceleration to the inertial mass 28 in the direction of arrow "A".

As seen in FIG. 3, the user 30 continues to accelerate the accommodating resistance exercise devices 20 of the instant invention in a forward direction as indicated by directional arrow "B" and in so doing has contracted those muscles in the arms, torso, and legs needed to produce an acceleration force to overcome the inertia of the devices 20.

FIG. 4 depicts the user in a posture at approximately the other extreme end of the stroke wherein the isokinetic exercise devices 20 have been accelerated forward and in the direction of arrow 'C' and are now decelerated through contractions in the muscles in the arms, back, and legs of the user to overcome the inertia of the devices. In this one exercise routine, once the limit of the user's flexibility is achieved in a forward direction, the inertial force, accommodating resistance exercise devices 20 are rapidly accelerated in the opposite direction until the user has returned to the position depicted in FIG. 2, and the sequence is repeated until the user has experienced the desired degree of exertion.

As indicated in the foregoing, the amount to user-initiated force is proportional to the mass of the device and the acceleration provided to it. The user-initiated force and the inertial resisting force are equal. Accordingly, the subject invention is accommodating in the sense that the magnitude of the resistance of the inertial force which the user experiences is dependent and equal to the amout of the user-initiated force as determined by the acceleration imparted by the user 30 and the mass of the device.

As stated above, the quality and quantity of the resistance during the exercise is determined by the acceleration applied by the user and the mass of the exercising units 20. The endurance requirement for accomplishing the exercises routine is a factor of the rapidity of the strokes and their frequency of repetition. During the entire exercise stroke, however, it will be noted that the axle of the inertial force, accommodating resistance exercise device and the inertial masses affixed thereto translate along a surface as the user rolls the devices. The relatively lightweight wheels are designed to be rolled acceleratedly and deceleratedly across a surface with a minimum amount of friction.

The sequence of exercise of FIGS. 2–4 shows that the arms of the user would rotate back and forth through an angle of approximately 90 degrees. In accordance with the embodiment shown in FIG. 1, the sleeve 160 in the grasp of the user would continually rotate on the axle through this same angle. Having the sleeve as a member of a rotational inertia system separate from the axle with inertial mass attached permits the user to rotate the sleeve and change the direction or the sleeve's rotation without causing the inertial mass to rotate in either direction. This feature minimizes or eliminates the torque that would be generated if the sleeve, axle, and inertial mass were members of the same system where rotating the sleeve would rotate the inertia mass and would influence the sleeve to twist in the user's hand at changes in the sleeve's rotation. The result of incorporating the embodiment shown in FIG. 1 into the device used to perform the exercise sequence shown by FIGS. 2–4 is that the user is able to accomplish accelerated translations and rapid direction changesin a rhythmic, fluid, and harmonious manner and experience pleasing single vector resistance while gaining the benefits of inertial force, accommodating resistance exercise.

Although FIGS. 2–4 disclose one particular routine, it will be realized by those skilled in the art that a number of other exercise routines are fully contemplated in using the instant exercise device in accordance with an embodiment of the invention and that the number and variety of exercise routines is limited only by the imagination of the user. In this connection, it is also contemplated that a user may attach an exercise device, in accordance with the invention, to each foot and that the devices can be propelled back and forth across a surface by a user's legs. Moreover, while FIGS. 2–4 disclose rolling the device across a generally horizontal floor surface, it is envisioned that an inertial force, accommodating exercise device could also be used to advantage by being acceleratedly rolled on a vertical surface such as a wall or an inclined surface such as a ramp or the like.

Continuing now with a detailed description of the device, FIG. 5 is a side elevation view of one side of the embodiment shown in FIG. 1. It displays the relationship between the inertial mass 28 and the axle 26, which is uniform in diameter throughout, wherein said inertial mass has a threaded bore 52 to receive a threaded end 54 of said axle. The threaded bore and axle end enable the inertial mass to retain the wheel 24 on the axle when the device is rapidly rolled, and they prevent the inertial mass from experiencing rotational forces from the wheel when the device is rapidly rolled to perform exercise. They also permit the size of the inertial mass to be varied by substituting matched pairs of inertial mass at each end of the axle. The wheel 24 is rotatably mounted on a sleeve 46 which surrounds a portion of said axle between control sleeve 160 and mass 28. As indicated by FIGS. 2–4, the sleeve 160 in a third rotational inertia system serves as a control section for the device. It also prevents or minimizes the transmission of rotational forces through the axle to the inertial mass affixed to the end thereof and vice versa. The sleeve is cylindrical and may rotate about said axle while grasped by a user during rapid translational direction changes of the exercise device. The properties of the material of which the sleeve is constructed and the dimension of the bore of the sleeve allow the sleeve to slip around the axle. The sleeve may also be lubricated on the surface contacting the axle to enhance the rotation of the sleeve about the axle. These constructions eliminate or minimize the generation of torque during exercise by enabling the sleeve to facilely rotate around the axle with inertial mass rigidly attached to the ends thereof. The sleeve is not co-extensive with the entire length of the axle and extends up to an annular ring 50. This ring isolates the sleeve from the rotation of the wheel and prevents the sleeve from impeding the rotation of the wheel. The other end of the exerciser device would entail a similar construction as described above with regard to FIG. 5. In this embodiment, the axle may be ½ inch in diamter, the sleeve 1¼ inch, and the wheel 7 inches.

A variation of the embodiment shown in FIG. 5 may be constructed by having a threaded bore at each end of said axle for receiving a thread extension on an inertial mass. This is another viable way for fixably coupling said axle with said inertial mass, instead of having the bore in the inertial mass and the extension on the axle as illustrated in FIG. 5.

It should be noted that in the embodiment of FIGURE 5, the inertial mass may be alternatively located inside of the corresponding wheel means, in which case a cap member may be attached to the axle end for keeping the wheel means on the axle. This alternative embodiment may be a safer configuration since it minimizes the number of protruding elements.

Turning now to FIG. 6, there is another embodiment of the instant invention which is also operative in a manner that eliminates or minimizes the generation of torque by incorporating a third rotational inertia system. In this embodiment, sleeve 160 of FIGS. 1 and 5 is eliminated. FIG. 6 also shows an axle 26 having an enlarged control mid portion 27 for grasping by a user and a reduced diameter end extension 62 (only one shown). However, two segment sleeves, 46 and 170 are shown enveloping said end extension. An inertial mass 28 having a bore 174 is rotably mounted on an axle end via segment sleeve 170. A cap 172 having a threaded bore 52 for retaining the inertial mass on the axle is also threadably received on a threaded axle end 52. Removing the cap and exchanging the inertial mass permits the size of the inertial mass to be varied. The segment sleeves 46 and 170 can be made of any material that may act as a bearing or lubricant and its bore is of a dimension which permits the axle to rotate therein when the axle is grasped by a user at its mid section 27 and moved through the various angles of rotation required by different exercise routines. The sleeve 170 may also be lubricated on the surface contacting the axle to enhance the rotation of the axle therein. The wheel 24 is rotatably mounted about sleeve 46 as is mass 28 on sleeve 170. These features establish the inertial mass in a rotational inertia system separate from that of the axle and from that of the wheels and therfore, enable the accelerated translation and rapid direction changes of the inertial mass while eliminating or minimizing the generation of torque which would influence the control area to twist in the hand of the user enables the user to perform rhythmic, fluid, and harmonious exercise wherein accommodating, single vector resistance is experienced as is permitted by the embodiment described. The other end of the exerciser device would entail a similar construction as described above with regard to FIG. 6.

Turning now to FIG. 7, there is a variation of the instant invention shown by FIG. 6 which also establishes the inertial mass in a rotational inertia system separate from that of the axle and from that of the wheels. In FIG. 7, the inertial mass 28 with a sleeve 170 is mounted on said axle inside of said wheel. The size of the inertial mass may be varied by removing the cap and wheel and exchanging the inertial mass. The annular ring 50 isolates the inertial mass 28 from the rotation of the wheel 24. This particular embodiment is especially of practical significance from a safety point of view since it removes the protruding inertial mass from external exposure.

In the embodiments shown in FIGS. 6 and 7, the ring element 50 is inserted on said reduced end section of the axle between said wheel and said inertial mass for ensuring separation thereof in independent rotation actions. However, such an element is not necessary for operation of the subject invention.

Furthermore, with regard to the disclosed embodiments, it is not necessary that both ends of an exerciser device employ an identical construction according one disclosed embodiment. Each end of an exerciser may be of different construction according to a different one of the afore-disclosed embodiments, and the resulting structure constitutes another embodiment of the instant invention in itself. Also, with regard to the embodiments shown in FIGS. 6 and 7, although the axle includes reduced diameter end portions, it should be noted that an axle having a uniform diameter as in the embodiments of FIGS. 1 and 5 may be used as well.

SUMMARY OF MAJOR ADVANTAGES OF THE INVENTION

After reading and understanding the foregoing description of the invention, in conjunction with the drawings, it will be appreciated that several distinct advantages of the subject inertial force, accommodating resistance device and method are obtained.

Without attempting to set forth all of the desirable features of the instant accommodating resistance exercise device, as specifically and inherently disclosed here and above, at least some of the major advantages of the invention provide the unique provision of variable inertial mass which is connected to an axle for translation across an exercise surface and which is isolated from the rotation of the control means of the device in a separate rotational inertia system in order to eliminate or minimize the generation of torque by the inertial mass. The user's hands, wrists, and arms or feet, ankles, and legs have, therefore, the pleasing experience of accommodating, single vector resistance during the performance of inertial force exercise routines.

An inertial force, accommodating resistance exercise device, in accordance with the various embodiments of the instant invention, provides a means of exercising to develop aerobic fitness, muscular strength, muscular endurance, flexibility, and coordination by the provision of an inertial mass connected to an axle which may be freely translated across a surface. The provision of an inertial mass which may be translated on a surface such as a floor, wall, or ramp in order to generate an inertial force, efficiently exercises the body as the device is repeatedly accelerated and decelerated in an oscillating pattern.

The provision of lightweight rotating wheels enables the device to be facilely translated across a surface to provide a continuous, rhythmic, and fluid series of actions and reactions in overcoming the inertia of the mass being translated in rapid rolling maneuvers.

The instant invention contemplates a number of preferred embodiments wherein the amount of the inertial mass may be facilely varied to enable the device to be utilized by a wide range of users having variant aerobic capacity, strength, endurance, flexibility, and coordination.

The provision of specific embodiments wherein enhanced masses may be added to the structure between relative lightweight, rollable wheels enables a user to significantly increase the mass and thus resistance of the exercise device without encumbering its full use. More specifically, in these embodiments, a structure may be assembled which will not interfere or contact with an arm or leg during a full range of motion utilizing the exercising device.

The variety and versatility of the device enables a user to perform a series of exercises in a sitting, standing, kneeling, or lying position on a floor; or in a standing or lying position on a wall surface suitable to strengthen all major muscle groups and develop flexibility, endurance, coordination, and aerobic capacity.

Still further, accelerating the inertial mass of the instant invention permits a user to perform exercises as a training alternative for athletic activity in a manner that duplicates the requirements of range of joint action, speed, movement pattern, etc., which are inherent in physical athletic activities.

If the control area, the axle, and the inertial mass are made of rigid construction and are, therefore, members of the same rotational inertial system, undesirable torque is exerted on a user influencing the control area to twist during exercise routines where there is a swinging motion as depicted in FIGS. 2, 3, and 4. As the swinging rate increases, this torque effect on the control area is magnified particularly at the change from rapid deceleration in one direction to rapid acceleration in the opposite direction. The specific embodiments illustrated in FIGS. 1, 5, 6 and 7 eliminate or minimize this torque problem by flexibly constructing the connection between the control area and the inertial mass so as to place them in a separate rotational inertia systems. In these embodiments, there are three essentially independent rotational inertia systems.

In describing the invention, reference has been made to preferred embodiments and illustrative advantages of the invention. Those skilled in the art, however, and familiar with the instant disclosure of the subject invention, may recognize additions, deletions, modifications, substitutions, and/or other changes which will fall within the purview of the subject invention and claims.

What is claimed is:

1. An inertial force, accommodating resistance exercise device for exercising the body through effort required to overcome the inertia of a mass being accelerated and translated during surface oscillations, said exercise device comprising:

a first wheel means operable to engage, roll, and be accelerated upon a surface during an exercise routine;

a second wheel means operable to engage, roll and be accelerated upon a surface during an exercise routine;

axle means supporting said first and said second wheel means and having a control section for the user to accelerate said exercise device and said first and second wheel means being rotatably mounted upon the end segments of said axle means, in a mutually parallel posture for rotation with respect to said axle means upon acceleration and translation of said axle means by a user across a surface during an exercise routine;

first and second inertial mass structures supported by said axle means through the centers of gravity of said first and second inertial mass structures for operative acceleration and translation with said axle means during accommodating resistance exercise routines for providing an inertial resistance through acceleration and translation of said first and second inertial mass structures to exercise a user's body and provide overall fitness; and means located where said axle supports said first and second inertial mass structures for facilitating translation of said first and second intertial mass structures without rotation with respect to a surface in order to eliminate or minimize the generation of torque between said first and second inertal mass structures and said axle for permitting an arm or a leg of a user to rotate freely through various angles of rotation with respect to said first and second inertial mass structures when the user accelerates and decelerates said exercise device and changes the direction of said exercise device on a surface to perform inertial force, accommodating resistance exercise.

2. An inertial force, accommodating resistance exercise device as defined in claim 1 wherein:

said first and second inertial mass structures are respective first and second inertial disc members each having a central axis and hub and being coaxially mounted through said hub of each of said first and second inertial disc members on said end segments of said axle means adjacent to a respective one of said first and second wheel means.

3. An inertial force, accommodating resistance exercise device as defined in claim 2 wherein:

means located where said axle supports said first and second inertial mass structures for facilitating translation of said first and second intertial mass structures without rotation with respect to a surface in order to eliminate or minimize the generation of torque between said first and second inertial mass structures and said axle comprises a bearing sleeve mounted upon an inner periphery of said hub of eAch of said first and second inertial disc members.

4. An inertial force, accommodating resistance exercise device as defined in claim 2 wherein:

means located where said axle supports said first and second inertial mass structures for facilitating translation of said first and second intertial mass structures without rotation with respect to a surface in order to eliminate or minimize the generation of torque between said first and second inertial mass structures and said axle comprises a lubricant applied to the inner periphery of said hub of each of said first and second inertial mass disc members.

5. An inertial force, accommodating resistance exercise device as defined in claim 2 wherein:

means located where said axle supports said first and second inertial mass structures for facilitating translation of said first and second intertial mass structures without rotation with respect to a surface in order to eliminate or minimize the generation of torque between said first and second inertial mass structures and said axle comprises an outside diameter of each of said end segments of said axle smaller than the inside diamEters of said hub of each of said first and second inertial disc members so as to permit each of said end segments of said axle to slip, play, or rotate within said hub of eAch of said first and second intertial disc members.

6. An inertial force, accommodating resistance exercise device as defined in claims 3, 4, or 5 wherein:

said first inertial disc member is mounted upon said axle means outside of said first wheel means; and said second inertial disc member is mounted upon said axle means outside of said second wheel means.

7. An inertial force, accommodating resistance exercise device as defined in claims 3, 4, or 5 wherein:

said first disc member is mounted upon said axle means inside of said first wheel means; and said second inertial disc member is mounted upon said axle means inside of said second wheel means.

8. An inertial force, accommodating resistance exercise device as defined in claims 3, 4, or 5 wherein:

said control section of said axle comprises the mid portion of said axle.

9. An inertial force, accommodating resistance exercise device as defined in claims 3, 4, or 5 further comprising:

means for permitting variation of the mass of said first and second disc members for increasing or decreasing inertial opposition during an exercise routine according to the requirements of an exercise and strength of a user.

10. An inertia force, accommodating resistance exercise device as defined in claims 3, 4, or 5 further comprising:

means for retaining said first and second inertial disc members and said first and second wheel means upon said axle during an exercise routine.

* * * * *